US006383462B1

(12) United States Patent
Lang

(10) Patent No.: US 6,383,462 B1
(45) Date of Patent: May 7, 2002

(54) FUEL DILUTION METHODS AND APPARATUS FOR $NO_X$ REDUCTION

(75) Inventor: Jerry M. Lang, Lindale, TX (US)

(73) Assignee: John Zink Company, LLC, Tulsa, OK (US)

( * ) Notice: Subject to any disclaimer, the term of this patent is extended or adjusted under 35 U.S.C. 154(b) by 0 days.

(21) Appl. No.: 09/597,014

(22) Filed: Jun. 20, 2000

Related U.S. Application Data

(63) Continuation-in-part of application No. 09/547,769, filed on Apr. 12, 2000.
(60) Provisional application No. 60/161,536, filed on Oct. 26, 1999.

(51) Int. Cl.[7] ..... B01D 53/54; B01D 53/60
(52) U.S. Cl. ..... 423/235; 110/345; 422/183; 423/210
(58) Field of Search ..... 110/204, 205, 110/345; 422/182, 183, 234; 423/210, 235; 431/5, 12, 116

(56) References Cited

U.S. PATENT DOCUMENTS 4,995,807 A * 2/1991 Rampley et al. ..... 431/9
5,603,906 A * 2/1997 Lang et al. ..... 422/182

* cited by examiner

*Primary Examiner*—Steven P. Griffin
*Assistant Examiner*—Marikel Medina
(74) *Attorney, Agent, or Firm*—McAfee & Taft; C. Clark Dougherty, Jr.

(57) ABSTRACT

Methods and apparatus for reducing the content of nitrogen oxides in the flue gases produced by the combustion of fuel gas and combustion air introduced into a burner connected to a furnace are provided. The methods basically comprise the steps of conducting the combustion air to the burner, providing a chamber outside of the burner and furnace for mixing flue gases from the furnace with the fuel gas, discharging the fuel gas in the form of a fuel jet into the mixing chamber so that flue gases from the furnace are drawn into the chamber and mixed with and dilute the fuel gas therein and conducting the resulting mixture of flue gases and fuel gas to the burner wherein the mixture is combined with the combustion air and burned in the furnace.

23 Claims, 6 Drawing Sheets

FUEL DILUTION METHODS AND APPARATUS FOR $NO_X$ REDUCTION

CROSS-REFERENCE TO RELATED APPLICATIONS

This application is a continuation-in-part of U.S. patent application Ser. No. 09/547,769 filed on Apr. 12, 2000 which claims benefit of provisional application No. 60/161,536 filed on Oct. 26, 1999.

BACKGROUND OF THE INVENTION

1. Field of the Invention

The present invention relates to fuel dilution methods and apparatus for reducing the production of nitrogen oxides during the combustion of fuel gas and combustion air.

2. Description of the Prior Art

Nitrogen oxides ($NO_x$) are produced during the combustion of fuel-air mixtures at high temperatures. An initial, relatively rapid reaction between nitrogen and oxygen occurs predominantly in the combustion zone to produce nitric oxide in accordance with the reaction $N_2+O_2 \rightarrow 2NO$. The nitric oxide (also referred to as "prompt $NO_x$") is further oxidized outside the combustion zone to produce nitrous oxide in accordance with the reaction $2NO+O_2 \rightarrow 2NO_2$.

Nitrogen oxide emissions are associated with a number of environmental problems including smog formation, acid rain and the like. As a result of the adoption of stringent environmental emission standards by government authorities and agencies, methods and apparatus to suppress the formation of nitrogen oxides in flue gases produced by the combustion of fuel-air mixtures have been developed and used heretofore. For example, methods and apparatus wherein fuel is burned in less than a stoichiometric concentration of oxygen to intentionally produce a reducing environment of CO and $H_2$ have been proposed. This concept has been utilized in staged air burner apparatus wherein the fuel is burned in a deficiency of air in a first zone producing a reducing environment that suppresses $NO_x$ formation, and then the remaining portion of air is introduced into a second zone.

Other methods and apparatus have been developed wherein flue gases are combined with fuel or fuel-air mixtures in burner structures to thereby dilute the mixtures and lower their combustion temperatures and the formation of $NO_x$. In another approach, flue gases have been recirculated and mixed with the combustion air supplied to the burner upstream of the burner.

While the above described techniques for reducing $NO_x$ emissions with flue gas have been effective in reducing $NO_x$ formation and flue gas $NO_x$ content, there are certain disadvantages and drawbacks associated with them. For example, in converting existing furnaces (including boilers) to flue gas recirculation, the modification or replacement of the existing burner or burners and/or combustion air blowers and related apparatus is often required. The modifications often result in increased flame spread and other combustion zone changes which require internal alterations to the furnaces in which modified burners are installed. The changes and modifications required often involve substantial capital expenditures, and the modified furnaces and burners are often more difficult and costly to operate and maintain than those they replaced.

Thus, there are continuing needs for improved methods and apparatus for reducing $NO_x$ formation and emissions in and from existing furnaces without the substantial modifications and expenditures which have heretofore been required.

SUMMARY OF THE INVENTION

The present invention provides methods and apparatus which meet the needs described above and overcome the deficiencies of the prior art. The methods of the present invention for reducing the content of nitrogen oxides in the flue gases produced by the combustion of an at least substantially stoichiometric mixture of fuel gas and combustion air introduced into a burner connected to a furnace are basically comprised of the following steps. The combustion air is conducted to the burner, and a mixing chamber is provided outside of the burner and furnace for mixing flue gases from the furnace and a flow motivating gas with the fuel gas. The fuel gas is discharged in the form of a fuel jet into the mixing chamber so that flue gases from the furnace are drawn into the chamber and mixed with and dilute the fuel gas therein. A flow motivating gas such as steam is also discharged in the form of at least one jet into the mixing chamber so that additional flue gases from the furnace and additional fuel gas, if needed, are drawn into the mixing chamber and mix with each other and the flow motivating gas. The flue gases, flow motivating gas and fuel gas mixture formed in the mixing chamber is conducted to the burner wherein the mixture is combined with the combustion air and burned in the furnace.

The apparatus of this invention can be integrated into an existing burner-furnace system without substantially modifying or replacing existing burners, air blowers and the like and reduces the content of nitrogen oxides in the flue gases produced by the combustion of fuel gas and combustion air in the furnace. At most, the burners may require minor modifications to accommodate the increased mass and reduced pressure of the flue gases, flow motivating gas and fuel gas mixture, e.g., the replacement of the burner tips.

The apparatus is basically comprised of a mixing chamber which is separate from the burner and furnace for mixing flue gases from the furnace and flow motivating gas with the fuel gas prior to when the fuel gas is conducted to the burner. The mixing chamber includes a fuel gas inlet for connection to a fuel gas conduit and for forming a fuel jet within the mixing chamber, a flue gases inlet positioned so that flue gases are drawn into the chamber by the fuel jet, a flow motivating gas inlet for forming a jet within said first chamber so that additional flue gases and additional fuel gas, if needed, are drawn into the mixing chamber and a flue gases, flow motivating gas and fuel gas mixture outlet. A flue gases conduit for connection to the furnace is connected to the flue gases inlet of the chamber. A flow motivating gas conduit for connection to a source of the flow motivating gas is connected to the flow motivating gas inlet of the mixing chamber, and a flue gases, flow motivating gas and fuel gas mixture conduit for connection to the burner is connected to the flue gases, flow motivating gas and fuel gas mixture outlet of the chamber.

It is, therefore, a general object of the present invention to provide fuel dilution methods and apparatus for $NO_x$ reduction.

Other and further objects, features and advantages of the invention will be readily apparent to those skilled in the art upon a reading of the description of preferred embodiments which follows when taken in conjunction with the accompanying drawings.

BRIEF DESCRIPTION OF THE DRAWINGS

FIG. 6 is a schematic illustration of the apparatus of the present invention which is the same as FIG. 3 except that it includes both a mixing chamber for mixing a flow motivating gas with the flue gases from the furnace connected to the flue gases conduit and a second flue gases conduit connected between the furnace and the air blower.

DESCRIPTION OF PREFERRED EMBODIMENTS

The present invention provides methods and apparatus for reducing the content of nitrogen oxides in the flue gases produced by the combustion of fuel gas and combustion air introduced into a burner connected to a furnace. The apparatus of this invention can be added to a furnace having one or more burners connected thereto or to a plurality of such furnaces without replacing existing combustion air fans or blowers and without substantially modifying or replacing the existing burners. The apparatus is simple and can be readily installed which reduces furnace down time and installation costs. More importantly, the methods and apparatus of this invention are more effective in reducing $NO_x$ production than prior methods and apparatus and are more efficient in operation.

The methods and apparatus utilize recirculated flue gases which are thoroughly mixed and blended with the fuel gas thereby diluting the fuel gas well before it is introduced into one or more burners connected to a furnace. The flue gases diluted fuel gas is mixed with combustion air in the burner and combusted therein and in the furnace at a lower flame temperature and more uniform combustion is achieved. Both of these factors contribute to reduce the formation of prompt $NO_x$ which is generally not achieved to the same degree by the prior art.

Figure 1:
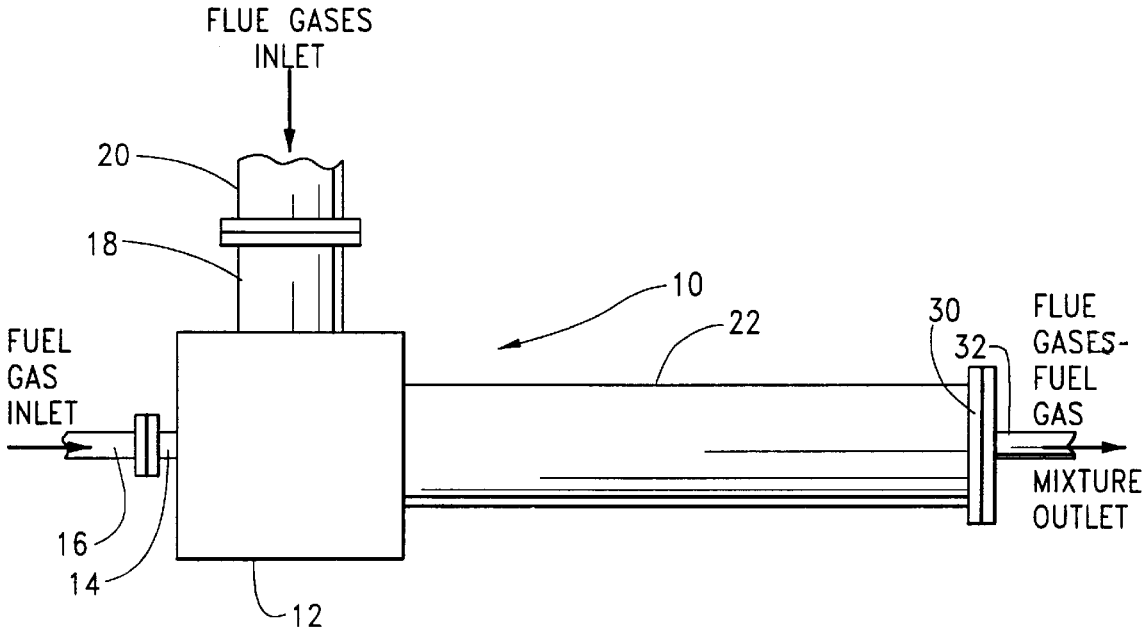
FIG. 1 is a side elevational view of a flue gases and fuel gas mixing chamber of the present invention.
Figure 2:
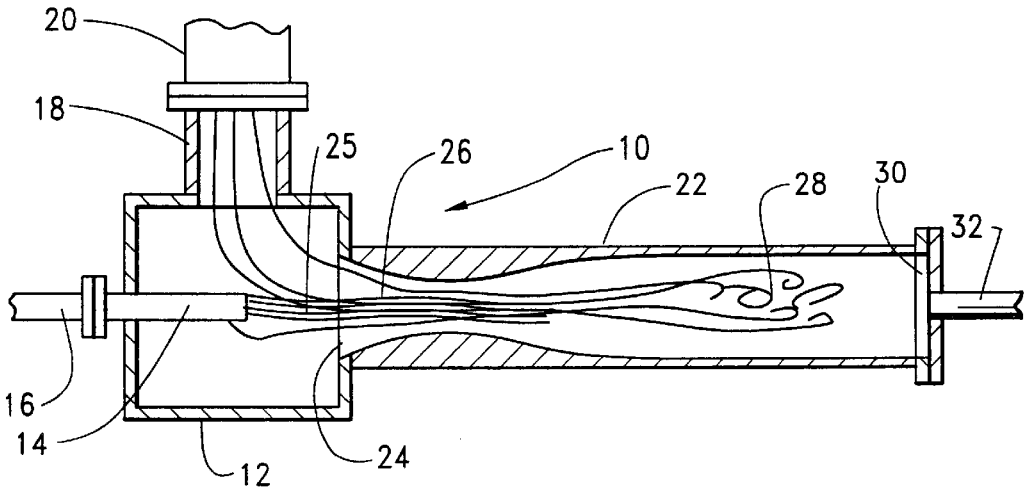
FIG. 2 is a side cross-sectional view of the mixing chamber of FIG. 1.

Referring now to the drawings, and particularly to FIGS. 1 and 2, a mixing chamber apparatus of the present invention is illustrated and designated by the numeral 10. The mixing chamber 10 includes a gas receiving compartment 12 having a fuel gas inlet connection 14 for connection to a fuel gas conduit 16 and a flue gases inlet connection 18 for connection to a flue gases conduit 20. The mixing chamber also includes a venturi tube 22 sealingly attached over an opening 24 in the gas receiving compartment 12 opposite the fuel gas inlet connection 14. As shown in FIG. 2, the fuel gas inlet connection 14 includes a nozzle portion which extends into the gas receiving compartment 12 so that a fuel jet 25 is formed therein which extends into and through the venturi section 26 of the venturi tube 22. As is well understood by those skilled in the art, the flow of the fuel jet 25 through the venturi section 26 creates a pressure drop in the gas receiving compartment 12 which causes flue gases to be drawn through the flue gases conduit 20 into the gas receiving chamber 12, through the venturi section 26 of the venturi tube 22 and into the downstream mixing section 28 thereof. The flue gases drawn into the mixing chamber 10 are thoroughly mixed with the fuel gas therein and are discharged from the mixing chamber 10 by way of a flue gases-fuel gas mixture outlet connection 30 to which a flue gases-fuel gas mixture conduit 32 is connected.

Figure 3:
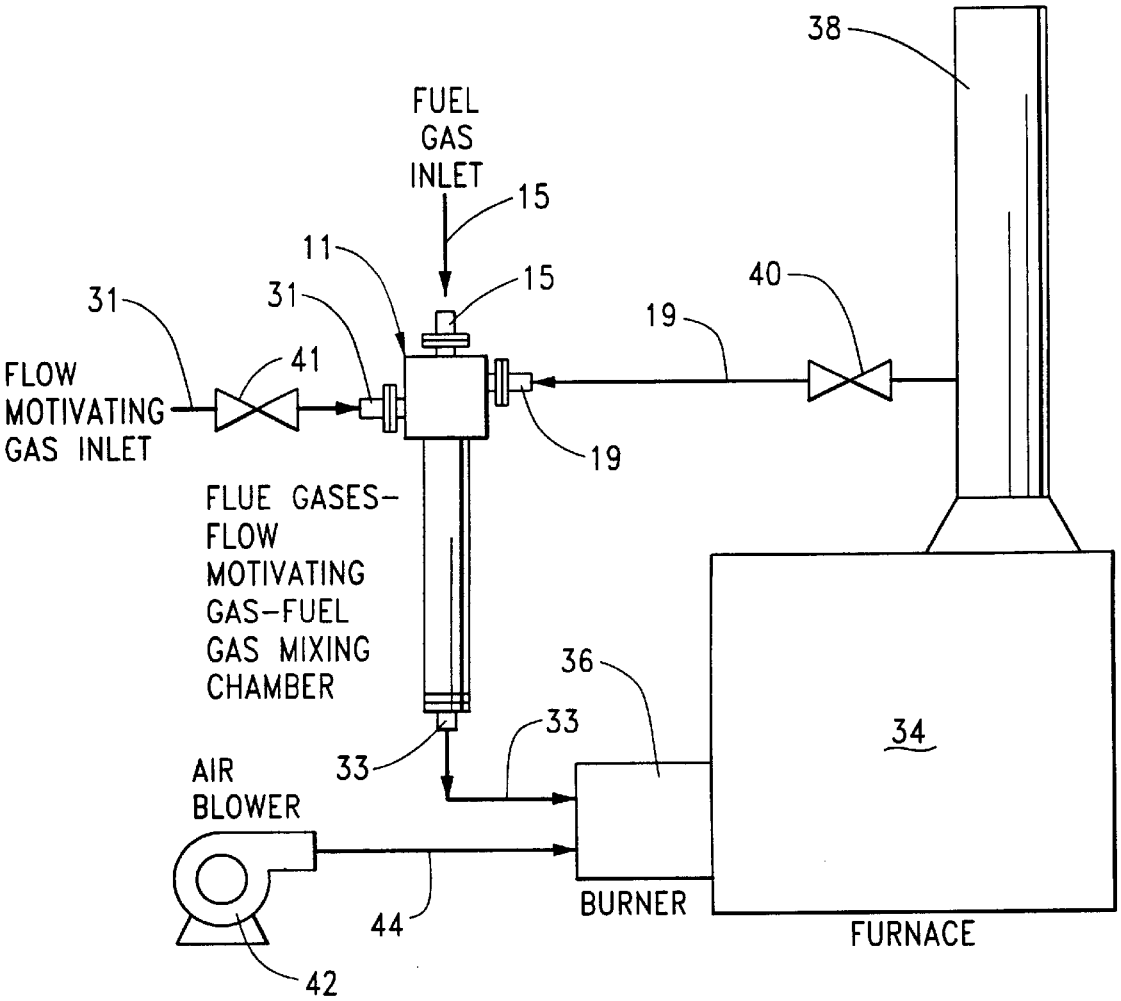
FIG. 3 is a schematic illustration of the apparatus of the present invention connected to a conventional burner and furnace.

Referring now to FIG. 3, an alternate embodiment of mixing chamber for mixing flue gases and a flow motivating gas with the fuel gas is shown and generally designated by the numeral 11. The mixing chamber 11 is schematically illustrated operably connected to a furnace 34 having a burner 36 connected thereto. As shown in FIG. 3, the mixing chamber 11 is connected to a fuel gas inlet conduit 15, the other end of which is connected to a source of pressurized fuel gas; to a flue gases conduit 19, the other end of which is connected to the furnace 34 (more particularly to the flue gases stack 38 thereof); to a flow motivating gas inlet conduit 31, the other end of which is connected to a source of flow motivating gas; and to a flue gases, flow motivating gas and fuel gas mixture conduit 33, the other end of which is connected to the fuel gas inlet connection of the burner 36. A flow control valve 40 is disposed in the flue gases conduit 19 for controlling the volume ratio of flue gases mixed with fuel gas in the mixing chamber 11, and a flow control valve 41 is disposed in the flow motivating gas inlet conduit 31 for controlling the volume ratio of flow motivating gas mixed with the fuel gas in the mixing chamber 11. A source of combustion air, e.g., a combustion air blower 42, is connected to a combustion air conduit 44, the other end of which is connected to the burner 36. The flow motivating gas is preferably steam, but other gases can be used in the place of the steam such as air, nitrogen, carbon dioxide and the like.

Figure 9:
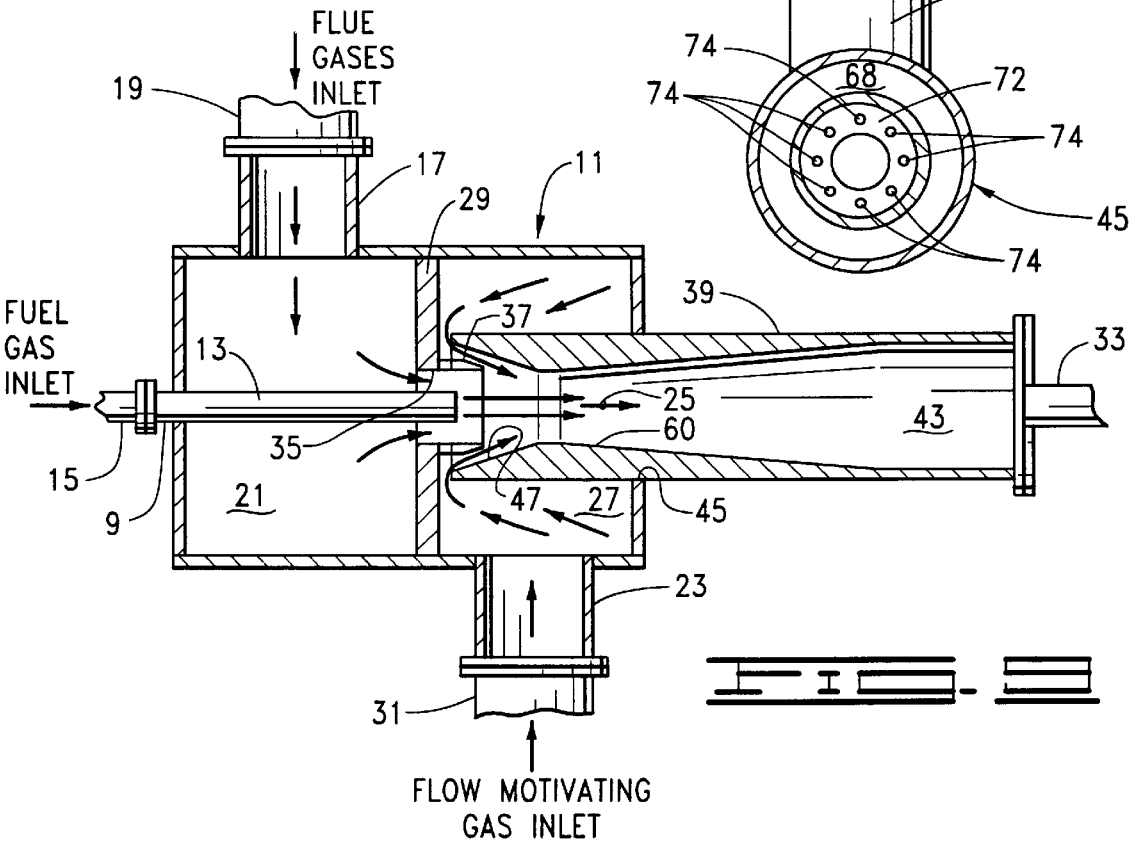
FIG. 9 is an enlarged side cross-sectional view of the mixing chamber for mixing flue gases from the furnace and flow motivating gas with the fuel gas shown in FIGS. 3 through 6.

Referring now to FIG. 9, the mixing chamber 11 is illustrated in detail. The mixing chamber 11 includes a gas receiving compartment 21 having a fuel gas inlet connection 9 connected to the fuel gas inlet conduit 15, a flue gases inlet connection 17 connected to the flue gases inlet conduit 19 and a flow motivating gas inlet connection 23 connected to the flow motivating gas inlet conduit 31. The mixing chamber 11 is divided into two compartments, 21 and 27 by a wall 29. The wall 29 includes a central opening 35 formed therein and the fuel gas inlet connection 9 includes a nozzle portion 13 which extends through the compartment 21 and into the opening 35 so that a fuel jet 25 (shown by arrows) is formed at the end of the nozzle portion 13. The compartment 21 receives flue gases conducted thereto by the flue gases conduit 19 and the compartment 27 receives the flow motivating fluid conducted thereto by the conduit 31. An annular deflector 37 is sealingly attached to the wall 29 over the opening 35 which extends into the compartment 27. A venturi tube 39 is sealingly attached through an opening 45 in the compartment 27 so that the fuel jet 25 formed by the nozzle portion 13 of the fuel gas inlet connection 9 extends into and through the venturi section 60 of the venturi tube 39. The open inlet end 47 of the venturi tube 39 extends over the outside surface of the annular deflector 37 so that flow motivating gas from the compartment 27 flows through a narrow annular space between the deflector 37 and the surface 47 of the venturi tube 39 and is formed into an annular jet within the venturi tube.

In operation of the mixing chamber 11, the flow of the fuel jet 25 through the venturi section 60 of the venturi tube 39 creates a pressure drop in the flue gases receiving compartment 21 which causes flue gases to be drawn through the flue gases conduit 19 into the flue gases compartment 21, through the venturi section 60 of the venturi tube 39 and into the mixing compartment 43 thereof where the flue gases and fuel gas are thoroughly mixed. Simultaneously, the flow of the annular flow motivating gas jet formed in the venturi tube 39 increases the pressure drop of the flue gases in the compartment 21 and the flow of flue gases into the venturi tube 39. At the same time, if the fuel gas pressure in the conduit 15 and the nozzle portion 13 of the connection 9 is low, the annular flow motivating gas jet produces a pressure drop in the fuel gas nozzle portion 13 and the fuel gas inlet conduit 15 and causes additional fuel gas to be drawn into the venturi tube 39. The flow motivating gas injected into the venturi tube 39 mixes with the flue gases and fuel gas in the mixing compartment 43 thereof and flows into the conduit 33 which conducts the mixture to the burner 36 (FIG. 3). The introduction of the flow motivating gas, e.g., pressurized steam, into the mixing chamber 11 also increases the pressure of the mixture of flow motivating gas, flue gases and fuel gas conducted to the burner 36. The increased pressure has the beneficial effect of allowing the mixture of flow motivating gas, flue gases and fuel gas which has a greater mass than fuel gas alone to be handled and burned by the burner 36 without the necessity of making modifications thereto.

Referring again to FIG. 3, combustion air produced by the combustion air blower 42 is conducted by the conduit 44 to the burner 36 and fuel gas is conducted by the conduit 15 to the mixing chamber 11. The amounts of fuel gas and combustion air are controlled by conventional flow control valves and controls or other similar apparatus (not shown) so that at least a substantially stoichiometric mixture of fuel gas and combustion air is introduced into the burner 36. As described above, the fuel gas forms a fuel jet in the mixing chamber 11 so that flue gases from the furnace are drawn into the mixing chamber 11 and are mixed with and dilute the fuel gas therein. Simultaneously, flow motivating gas conducted to the mixing chamber 11 forms at least one jet, preferably an annular jet as described above, so that additional fuel gas, if needed, and flue gases are drawn into the mixing chamber 11. Additional fuel gas is often needed in applications where only low pressure fuel gas is available, e.g., fire tube boilers which use low pressure fuel gas. As mentioned, steam is the preferred flow motivating gas, but if steam is not available, another flow motivating gas which is available can be utilized in the place of the steam such as air, nitrogen or carbon dioxide. The resulting mixture of flue gases, flow motivating gas and fuel gas formed in the mixing chamber 11 is conducted to the burner 36 by the conduit 33. The combustion air conducted to the burner 36 by the conduit 44 and the flue gases, flow motivating gas and fuel gas mixture conducted thereto by the conduit 33 are mixed within the burner 36. The resulting mixture is combusted in the burner 36 and the furnace 34 and flue gases are formed which are released to the atmosphere by way of the stack 38. A portion of the flue gases flowing through the stack 38 is continuously withdrawn therefrom by way of the conduit 19 connected thereto and is caused to flow into the mixing chamber 11 as described above. The flow control valves 40 and 41 are utilized to control the volume ratios of the flue gases and flow motivating gas mixed with the fuel gas in the mixing chamber 11 so that the maximum reduction of nitrogen oxides in the flue gases produced and vented to the atmosphere by way of the stack 38 is achieved.

Figure 4:
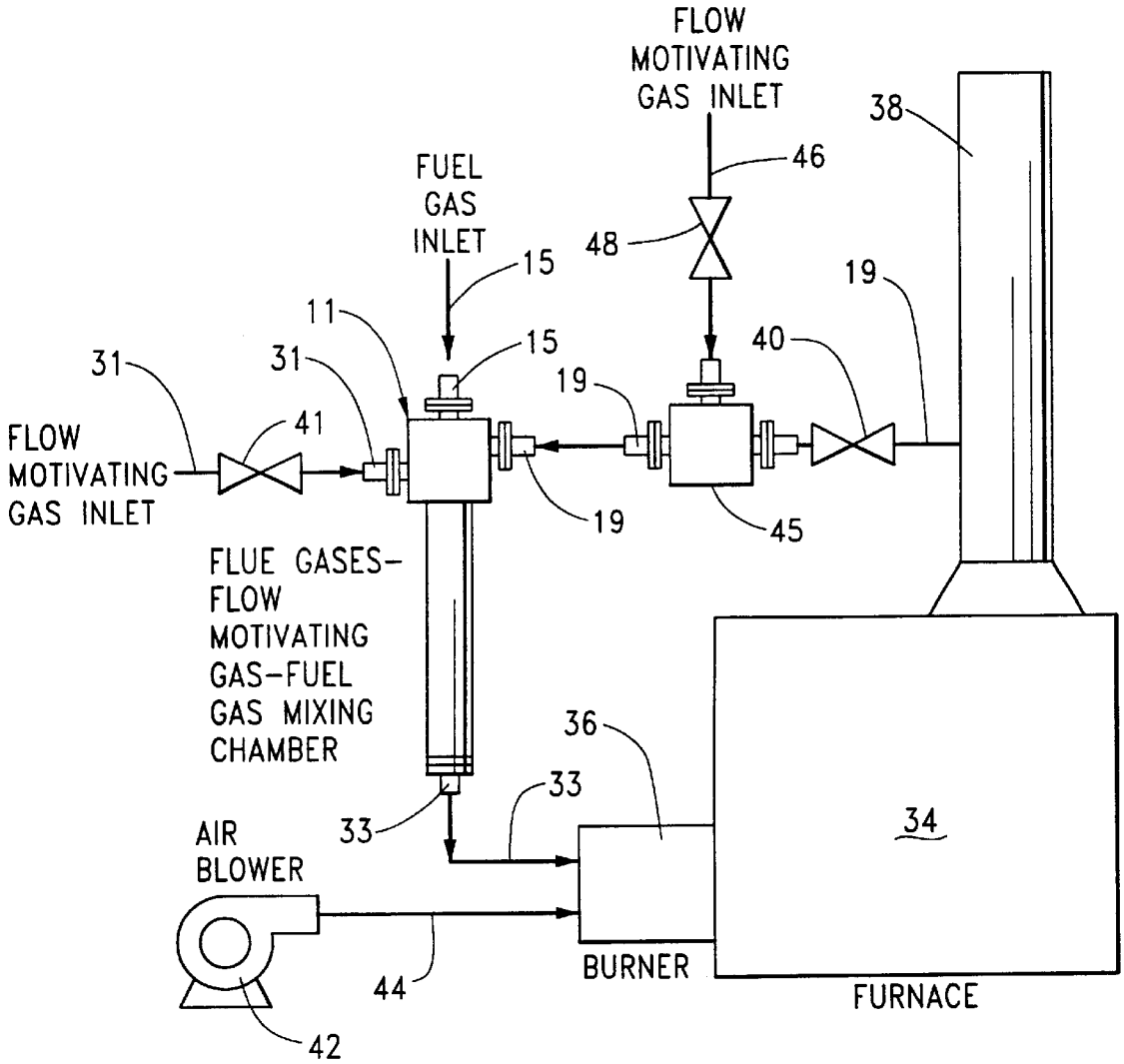
FIG. 4 is a schematic illustration of the apparatus of the present invention which is the same as FIG. 3 except that a mixing chamber for mixing a flow motivating gas with the flue gases from the furnace is included connected to the flue gases conduit.

Referring now to FIG. 4, the schematic illustration of the mixing chamber 11, the combustion air blower 42, the burner 36, the furnace 34 and connecting conduits is shown utilizing the same reference numerals as in FIG. 3. In addition, FIG. 4 includes a second mixing chamber 45 disposed in the flue gases conduit 19 at a point between the flow control valve 40 and the mixing chamber 11. A flow motivating gas inlet conduit 46 is attached to the second mixing chamber 45. The flow motivating gas inlet conduit 46 includes a flow control valve 48 disposed therein for controlling the volume ratio of flow motivating gas mixed with the flue gases in the second mixing chamber 45.

Figure 7:
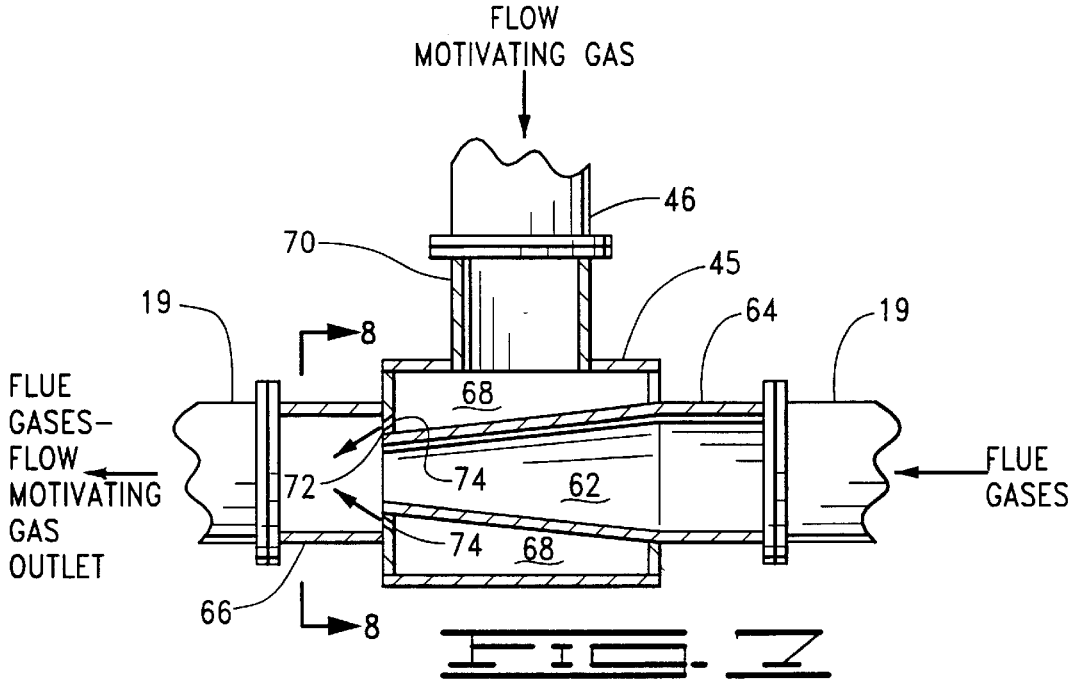
FIG. 7 is an enlarged, side cross-sectional view of the mixing chamber for mixing flow motivating gas with the flue gases from the furnace shown in FIGS. 4 and 6.
Figure 8:
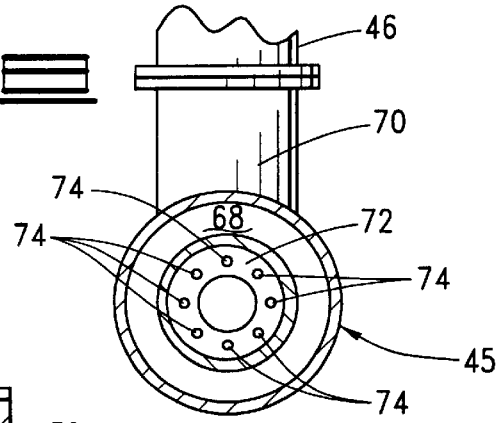
FIG. 8 is a cross-sectional view taken along line 8—8 of FIG. 7.

Referring now to FIG. 7, the second mixing chamber 45 is illustrated in detail. The second mixing chamber 45 includes a flue gases passageway 62 which communicates with a flue gases inlet connection 64 attached to one end of the mixing chamber 45 and a flue gases outlet connection 66 attached to the other end of the mixing chamber 45. A flow motivating gas compartment 68 within the mixing chamber 45 surrounds the flue gases passageway 62 and is connected to a flow motivating gas inlet connection 70. The flue gases inlet and outlet connections 64 and 66 are connected to the flue gases conduit 19 and the flow motivating gas inlet connection 70 is connected to the flow motivating gas inlet conduit 46.

The flue gases passageway 62 diverges towards the outlet connection 66 so that an annular end portion 72 of the flow motivating gas compartment 68 extends into the flue gases outlet connection 66. A plurality of orifices 74 which communicate the flow motivating gas compartment 68 with the interior of the flue gases outlet connection 66 are spaced around the annular end portion 72 of the compartment 68 which extends into the flue gases connection 66. The orifices 74 function to form flow motivating gas jets within the flue gases outlet connection 66 so that flue gases are drawn through the flue gases passageway 62 and mix with the flow motivating gas within the flue gases outlet connection 66 and the conduit 19 connected thereto.

The operation of the apparatus illustrated in FIG. 4 is identical to the operation described above for the apparatus illustrated in FIG. 3 except that additional flow motivating gas is mixed with the flue gases in the second mixing chamber 45 prior to when the flue gases are mixed with flow motivating gas and fuel gas in the first mixing chamber 11. The additional flow motivating gas is injected into the second mixing chamber 45 in the form of a plurality of jets which function to draw additional flue gases into the flue gases conduit 19. The flow motivating gas-flue gases mixture formed in the second mixing chamber 45 is conducted to the first mixing chamber 11. The resulting mixture of flow motivating gas, flue gases and fuel gas formed in the first mixing chamber 11 is conducted to the burner 36 wherein combustion air is mixed therewith and the resulting mixture is combusted in the burner 36 and furnace 34. The presence of the flow motivating gas in the combusted mixture further dilutes the fuel, reduces the flame temperature and reduces the content of nitrogen oxides in the flue gases discharged into the atmosphere.

Figure 5:
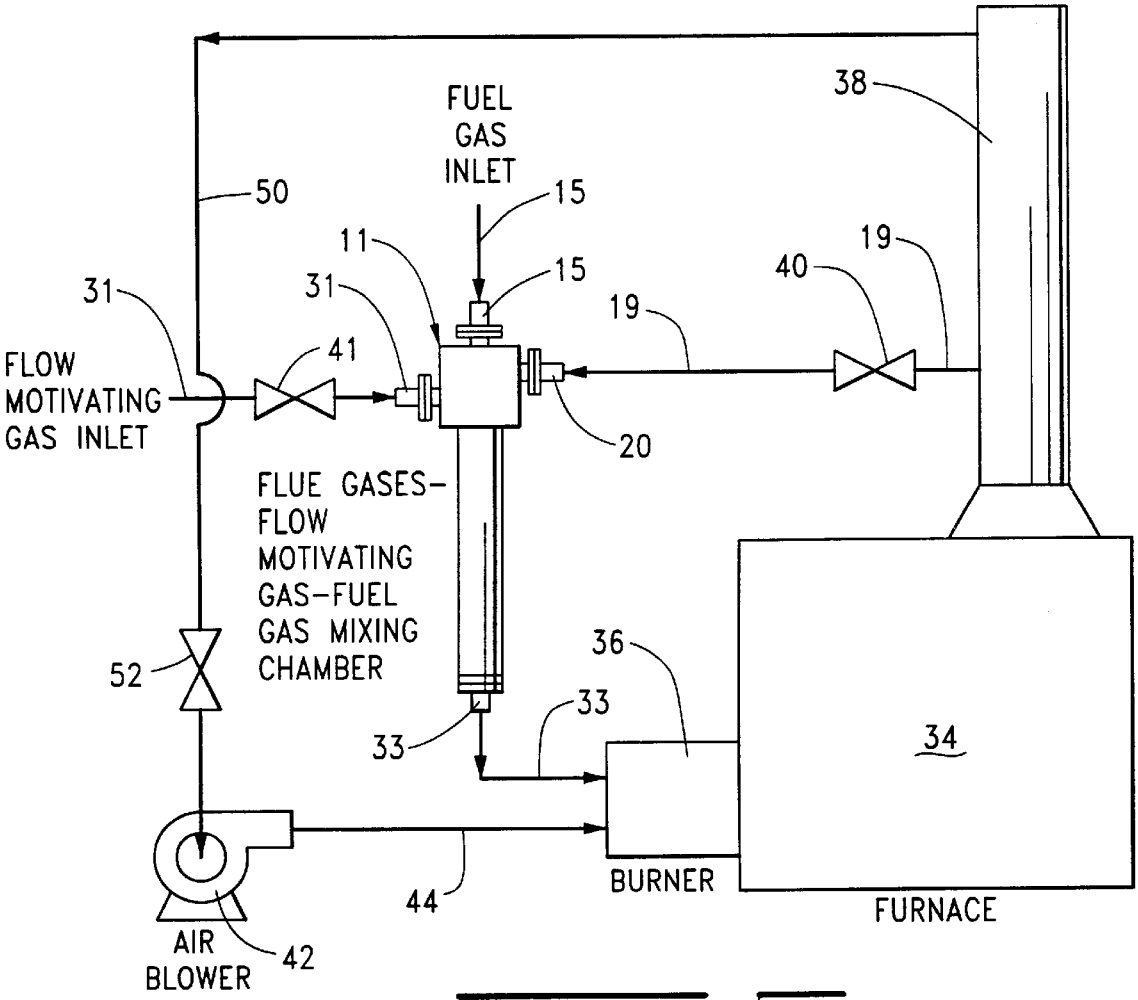
FIG. 5 is a schematic illustration of the apparatus of the present invention which is the same as FIG. 3 except that a second flue gases conduit is connected between the furnace and the air blower.
Figure 5:
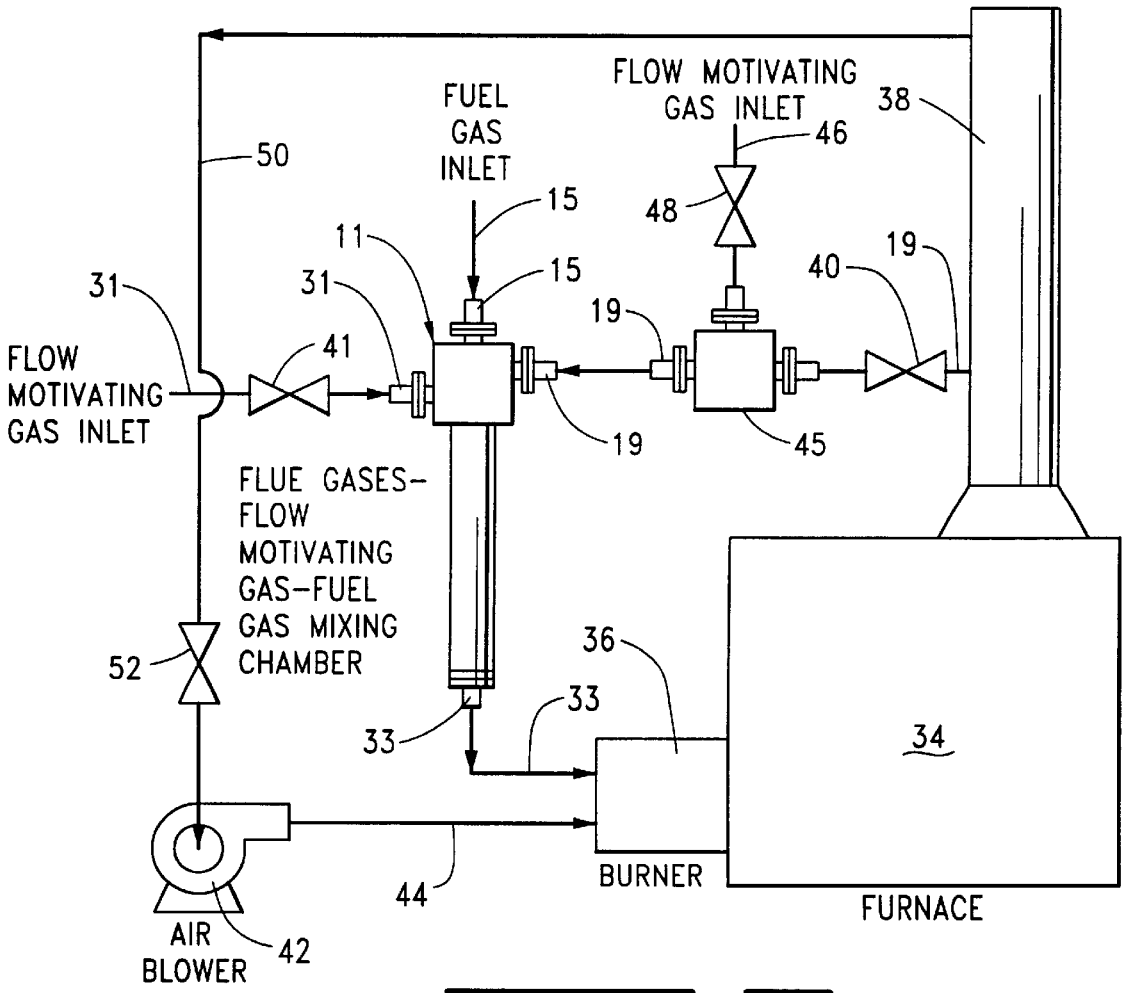

Referring now to FIG. 5, yet another embodiment of the invention is shown. That is, a schematic illustration of the mixing chamber 11, the combustion air blower 42, the burner 36 and the furnace 34 as well as the connecting conduits is shown in FIG. 5 utilizing the same reference numerals as in FIG. 3. In addition, a second flue gases conduit 50 is connected to the stack 38 of the furnace 34 and to an inlet connection in the combustion air blower 42 whereby additional flue gases are drawn from the stack 38 through the conduit 50 into the combustion air blower 42 wherein they mix with the combustion air. A flow control valve 52 is disposed in the conduit 50 for controlling the volume ratio of flue gases mixed with the combustion air.

The operation of the apparatus shown in FIG. 5 is the same as that described above in connection with the apparatus illustrated in FIG. 3 except that additional flue gases are introduced into the burner 36 in admixture with the combustion air. The presence of the additional flue gases in the combustion air functions to further cool the flame temperature in the furnace 34 and reduce the content of nitrogen oxide compounds in the flue gases discharged into the atmosphere from the stack 38.

Referring now to FIG. 6, yet another embodiment of the present invention is illustrated. A schematic illustration of the first mixing chamber 11, the second mixing chamber 45, the combustion air blower 42, the burner 36 and the furnace 34 as well as the connecting conduits is shown in FIG. 6 utilizing the same reference numerals as in FIG. 4. In addition, the apparatus illustrated in FIG. 6 includes the second flue gases conduit 50 and the flow control valve 52 disposed therein as illustrated in FIG. 5.

The operation of the apparatus of FIG. 6 is the same as the operation described above for the apparatus illustrated in FIG. 4 except that flue gases are also mixed with the combustion air. That is, flue gases and flow motivating gas are mixed with the fuel gas prior to conducting the resulting mixture to the burner 36, and flue gases are mixed with the combustion air in the combustion air blower 42 with the resulting mixture being introduced into the burner 36. By controlling the volumes of flue gases and flow motivating gas mixed with the fuel gas and the volume of flue gases mixed with the combustion air, the content of nitrogen oxides in the flue gases discharged to the atmosphere are minimized.

As will be understood by those skilled in the art, the selection of one of the systems of apparatus illustrated in FIGS. 3–6 depends on a variety of factors including, but not limited to, the size of the furnace or furnaces, the number of burners utilized with each furnace, the form and make-up of the fuel, the temperature reached within the interior of the furnace and the like. Based on such factors, the particular system of apparatus required to produce the desired low nitrogen oxides content in the flue gases discharged to the atmosphere is selected.

The methods of the present invention for reducing the content of nitrogen oxides in the flue gases produced by the combustion of an at least substantially stoichiometric mixture of fuel gas and combustion air introduced into a burner connected to a furnace are basically comprised of the following steps. Combustion air is conducted from a source thereof to the burner. A first mixing chamber is provided outside of the burner and furnace for mixing flue gases from the furnace and a flow motivating gas with the fuel gas. The fuel gas is discharged in the form a fuel jet into the first mixing chamber so that flue gases from the furnace are drawn into the chamber and mix with and dilute the fuel gas therein. The flow motivating gas is also discharged into the first mixing chamber in the form of at least one jet so that additional flue gases from the furnace and additional fuel gas, if needed, are drawn into the first mixing chamber and mix with each other and with the flow motivating gas. The mixture of flue gases, flow motivating gas and fuel gas formed in the first mixing chamber is conducted therefrom to the burner wherein the mixture is combined with the combustion air and then burned therein and in the furnace.

The above method preferably also includes the step of controlling the volume ratios of the flue gases and flow motivating gas mixed with the fuel gas. In addition, the method preferably includes the additional steps of providing a second mixing chamber outside of the burner and furnace for mixing additional flow motivating gas with the flue gases from the furnace, and discharging the flow motivating gas in the form of at least one jet into the second mixing chamber so that flue gases from the furnace are drawn into the second mixing chamber and mix with the flow motivating gas therein. Also, the method can include the additional steps of controlling the volume ratio of the flow. motivating gas mixed with the flue gases, mixing flue gases from the furnace with the combustion air conducted to the burner and controlling the volume ratio of the flue gases mixed with the combustion air.

The methods and apparatus of this invention have been shown to be significantly more efficient than prior art methods and apparatus. The recirculation of about 5% of the total flue gases in accordance with the invention as shown in FIG. 3 results in a lower nitrogen oxides content in the flue gases produced than a system wherein 23% of the total flue gases is combined with only the combustion air. Test results have indicated that a nitrogen oxides content in the flue gases of 20 parts per million or less is obtainable utilizing the methods and apparatus of this invention without steam injection, and without the concurrent use of flue gases recirculation in the combustion air. When steam injection into the flue gases is utilized in accordance with the present invention along with flue gases introduction into the combustion air, a flue gas nitrogen oxide content of from 8 to 14 parts per million can be achieved.

In order to further illustrate the improved results of the present invention, the following example is given.

EXAMPLE

The apparatus illustrated in FIG. 5 was tested to determine the nitrogen oxides content of the flue gases at various ratios of flue gases mixed with the fuel gas, various ratios of flue gases mixed with the combustion air and a combination of the two. The furnace utilized in the test was a 63.5 million BTU steam generator. The results of these tests are given in the Table below.

TABLE

Flue Gases $NO_x$ Content Using Various Amounts Of Flue Gases Mixed With Fuel Gas And/Or Combustion Air

| Test No. | Setting of Flue Gases Valve 40[1], percent open | Setting of Flue Gases Valve 52[2], percent open | $NO_x$ Content of Flue Gases Discharged to Atmosphere |
|---|---|---|---|
| 1 | 0% | 50% | 26 ppm |
| 2 | 50% | 0% | 23 ppm |
| 3 | 75% | 0% | 20 ppm |
| 4 | 50% | 35% | 18 ppm |
| 5 | 75% | 50% | 14 |

[1]Flue gases mixed with fuel gas.
[2]Flue gases mixed with combustion air.

From the above Table, it can be seen that the methods and apparatus of the present invention produce flue gases having unexpected reduced nitrogen oxides content.

Thus, the present invention is well adapted to carry out the objects and attain the ends and advantages mentioned as well as those which are inherent therein. While numerous changes may be made by those skilled in the art, such changes are encompassed within the spirit of this invention as defined by the appended claims.

What is claimed is:

1. A method of reducing the content of nitrogen oxides in flue gases produced by the combustion of an at least substantially stoichiometric mixture of fuel gas and combustion air introduced into a burner connected to a furnace comprising the steps of:

(a) conducting said combustion air to said burner;

(b) providing a first mixing chamber outside of said burner and furnace for mixing flue gases from said furnace and a flow motivating gas with said fuel gas, said mixing chamber including a fuel gas jet-forming nozzle, at least one flow motivating gas jet-forming deflector and a venturi and mixing compartment therein;

(c) discharging said fuel gas in the form of a fuel gas jet into said first mixing chamber by way of said fuel gas jet-forming nozzle so that flue gases from said furnace are drawn into said mixing chamber and mix with and dilute said fuel gas in said venturi and mixing compartment therein;

(d) discharging a flow motivating gas in the form of at least one flow motivating gas jet into said first mixing chamber by way of said flow motivating gas jet-forming deflector so that additional flue gases from said furnace and additional fuel gas, if needed, are drawn into said mixing chamber and mix with each other and with said flow motivating gas in said venturi and mixing compartment therein; and (e) conducting the mixture of flue gases, flow motivating gas and fuel gas formed in steps (c) and (d) to said burner wherein said mixture is combined with said combustion air and burned therein and in said furnace.

2. The method of claim 1 wherein said flow motivating gas is selected from the group consisting of steam, air, nitrogen and carbon dioxide.

3. The method of claim 1 wherein said flow motivating gas is steam.

4. The method of claim 1 which further comprises the step of controlling the volume ratios of said flue gases and said flow motivating gas mixed with said fuel gas in steps (c) and (d).

5. The method of claim 1 which further comprises the step of providing a second mixing chamber outside of said burner and furnace for mixing additional flow motivating gas with said flue gases from said furnace, and discharging said flow motivating gas in the form of at least one jet into said second mixing chamber so that flue gases from said furnace are drawn into said second mixing chamber and mix with said additional flow motivating gas prior to mixing with said flow motivating gas and fuel gas in accordance with steps (c) and (d).

6. The method of claim 5 which further comprises the step of controlling the volume ratio of said additional flow motivating gas mixed with said flue gases.

7. The method of claim 1 which further comprises the step of mixing flue gases from said furnace with said combustion air conducted to said burner in accordance with step (a).

8. The method of claim 7 which further comprises controlling the volume ratio of said flue gases mixed with said combustion air.

9. A method of reducing the content of nitrogen oxides in flue gases produced by the combustion of an at least substantially stoichiometric mixture of fuel gas and combustion air introduced into a burner connected to a furnace comprising the steps of:

(a) conducting said combustion air to said burner;

(b) providing a first mixing chamber outside of said burner and furnace for mixing flue gases from said furnace and steam with said fuel gas, said mixing chamber including a fuel gas jet-forming nozzle, at least one steam jet forming deflector and a venturi and mixing compartment therein;

(c) discharging said fuel gas in the form of a fuel jet into said first mixing chamber by way of said fuel gas jet-forming nozzle so that flue gases from said furnace are drawn into said chamber and mix with and dilute said fuel gas in said venturi and mixing compartment therein;

(d) discharging steam in the form of at least one steam jet into said first mixing chamber by way of said steam jet-forming deflector so that additional flue gases from said furnace and additional fuel gas, if needed, are drawn into said mixing chamber and mix with each other and with said steam in said venturi and mixing compartment therein; and (e) controlling the volume ratios of said flue gases and said steam mixed with said fuel gas in steps (c) and (d); and (f) conducting the mixture of flue gases, steam and fuel gas formed in steps (c) and (d) to said burner wherein said mixture is combined with said combustion air and burned therein and in said furnace.

10. The method of claim 9 which further comprises the step of providing a second mixing chamber outside of said burner and furnace for mixing additional steam with said flue gases from said furnace, and discharging said steam in the form of at least one jet into said second mixing chamber so that flue gases from said furnace are drawn into said second mixing chamber and mix with said additional steam prior to mixing with said steam and fuel gas in accordance with steps (c) and (d).

11. The method of claim 10 which further comprises the step of controlling the volume ratio of said additional steam mixed with said flue gases.

12. The method of claim 9 which further comprises the step of mixing flue gases from said furnace with said combustion air conducted to said burner in accordance with step (a).

13. The method of claim 12 which further comprises controlling the volume ratio of said flue gases mixed with said combustion air.

14. An apparatus for reducing the content of nitrogen oxides in flue gases produced by the combustion of an at least substantially stoichiometric mixture of fuel gas and combustion air, said fuel gas being conducted to a burner connected to a furnace by a fuel gas conduit and the combustion air being conducted from a source of combustion air to the burner by a combustion air conduit, comprising:

a first mixing chamber for mixing flue gases from said furnace and a flow motivating gas with said fuel gas having a fuel gas inlet for connection to said fuel gas conduit, a fuel gas jet-forming nozzle for forming a fuel gas jet within said mixing chamber, a flue gases inlet positioned so that flue gases are drawn into said mixing chamber by said fuel gas jet, a first flow motivating gas inlet, at least one flow motivating gas jet-forming deflector for forming a flow motivating gas jet within said mixing chamber so that additional flue gases and additional fuel gas, if needed, are drawn into said mixing chamber, a venturi and mixing compartment therein for mixing said flue gases, said flow motivating gas and said fuel gas and a flue gases, flow motivating gas and fuel gas mixture outlet;

a first flue gases conduit for connection to said furnace connected to said flue gases inlet of said first chamber;

a first flow motivating gas conduit for connection to a source of flow motivating gas connected to said flow motivating gas inlet of said mixing chamber; and a flue gases, flow motivating gas and fuel gas mixture conduit for connection to said burner connected to said flue gases, flow motivating gas and fuel gas mixture outlet of said chamber.

15. The apparatus of claim 14 which further comprises means for controlling the volume ratios of said flue gases and said flow motivating gas mixed with said fuel gas in said first mixing chamber disposed in said first flue gases conduit and said first flow motivating gas conduit.

16. The apparatus of claim 15 wherein said means for controlling the volume ratios of said flue gases and said flow motivating gas to said fuel gas are comprised of flow control valves.

17. The apparatus of claim 14 which further comprises a second mixing chamber for mixing flow motivating gas with said flue gases from said furnace having a flow motivating gas inlet for connection to a source of flow motivating gas and for forming a flow motivating gas jet within said second mixing chamber, a flue gases inlet connected to said first flue gases conduit positioned so that flue gases from said furnace are drawn into said second mixing chamber by said jet, a flow motivating gas-flue gases outlet connected to said first flue gases conduit and a flow motivating gas conduit for connection to a source of flow motivating gas connected to said flow motivating gas inlet of said second mixing chamber.

18. The apparatus of claim 17 which further comprises means for controlling the volume ratio of said flow motivating gas mixed with said flue gases disposed in said flow motivating gas conduit.

19. The apparatus of claim 18 wherein said means for controlling the volume ratio of said flow motivating gas mixed with said flue gases comprises a flow control valve.

20. The apparatus of claim 14 wherein said source of combustion air is a combustion air blower.

21. The apparatus of claim 20 which further comprises a second flue gases conduit for connection to said furnace and to said combustion air blower so that flue gases are mixed with said combustion air.

22. The apparatus of claim 21 which further comprises means for controlling the volume ratio of said flue gases mixed with said combustion air disposed in said second flue gases conduit.

23. The apparatus of claim 22 wherein said means for controlling the volume ratio of said flue gases mixed with said combustion air comprises a flow control valve.

* * * * *